US009939204B2

(12) United States Patent
Phan et al.

(10) Patent No.: US 9,939,204 B2
(45) Date of Patent: Apr. 10, 2018

(54) HEAT SPREADING MODULE

(71) Applicant: Fujikura Ltd., Tokyo (JP)

(72) Inventors: Thanhlong Phan, Tokyo (JP); Youji Kawahara, Tokyo (JP); Yuichi Yokoyama, Tokyo (JP); Yuji Saito, Tokyo (JP); Mohammad Shahed Ahamed, Tokyo (JP); Koichi Mashiko, Tokyo (JP)

(73) Assignee: FUJIKURA LTD., Tokyo (JP)

( * ) Notice: Subject to any disclaimer, the term of this patent is extended or adjusted under 35 U.S.C. 154(b) by 0 days.

(21) Appl. No.: 15/165,518

(22) Filed: May 26, 2016

(65) Prior Publication Data

US 2017/0343294 A1 Nov. 30, 2017

(51) Int. Cl.

| | |
|---|---|
| ***F28D 15/00*** | (2006.01) |
| ***F28D 15/02*** | (2006.01) |
| ***F28D 15/04*** | (2006.01) |
| ***F28F 3/08*** | (2006.01) |
| ***F28F 21/08*** | (2006.01) |
| *F28D 21/00* | (2006.01) |

(52) U.S. Cl.

CPC ..... *F28D 15/0266* (2013.01); *F28D 15/0258* (2013.01); *F28D 15/0283* (2013.01); *F28D 15/046* (2013.01); *F28F 3/08* (2013.01); *F28F 21/083* (2013.01); *F28F 21/084* (2013.01); *F28F 21/085* (2013.01); *F28F 21/089* (2013.01); *F28D 2021/0028* (2013.01)

(58) Field of Classification Search

CPC ..... F28D 15/0266; F28D 15/0258; F28D 15/0283; F28D 15/046; F28D 15/00; F28D 2021/0028; F28F 3/02; F28F 21/083; F28F 21/084; F28F 21/085; F28F 21/089; F28F 3/08

USPC ..... 165/104.26

See application file for complete search history.

(56) References Cited

U.S. PATENT DOCUMENTS

| | | | | |
|---|---|---|---|---|
| 5,937,936 | A | 8/1999 | Furukawa et al. | |
| 6,695,040 | B1 | 2/2004 | Kung et al. | |
| 2004/0069457 | A1 * | 4/2004 | Park | F28D 15/0266 165/104.21 |
| 2004/0069460 | A1 | 4/2004 | Sasaki et al. | |

(Continued)

FOREIGN PATENT DOCUMENTS

| | | |
|---|---|---|
| EP | 0 702 287 A2 | 3/1996 |
| JP | 03-186195 A | 8/1991 |
| JP | 04-073754 U | 6/1992 |

(Continued)

OTHER PUBLICATIONS

Japanese Office Action for 2015-109384 dated Feb. 9, 2016.

*Primary Examiner* — Davis Hwu

(74) *Attorney, Agent, or Firm* — Sughrue Mion, PLLC

(57) ABSTRACT

In a heat spreading module, a plurality of hollow paths is formed in a thin plate-shaped main body so as to pass though the heating portion, and the hollow paths communicate with each other in a heating portion, a working fluid is enclosed in the hollow paths, a wick is disposed in each of the hollow paths such that a vapor flow path in which vapor of the working fluid flows is formed in each of the hollow paths, a part of each wick is positioned at the heating portion, and the vapor flow paths formed in the hollow paths communicate with each other in the heating portion.

6 Claims, 3 Drawing Sheets

(56) References Cited

U.S. PATENT DOCUMENTS

| | | | | |
|---|---|---|---|---|
| 2014/0262175 | A1* | 9/2014 | Vanderwees ..... | F28F 3/083<br>165/166 |

FOREIGN PATENT DOCUMENTS

| | | | |
|---|---|---|---|
| JP | 08-061873 | A | 3/1996 |
| JP | 08-303971 | A | 11/1996 |
| JP | 10-122774 | A | 5/1998 |
| JP | 2002-286384 | A | 10/2002 |
| JP | 2003-343985 | A | 12/2003 |
| JP | 2004-028557 | A | 1/2004 |
| JP | 2012-132582 | A | 7/2012 |
| JP | 2014-022798 | A | 2/2014 |
| JP | 2015-210040 | A | 11/2015 |

* cited by examiner

HEAT SPREADING MODULE

CROSS REFERENCE TO RELATED APPLICATIONS

The present application claims priority with respect to Japanese patent application No. 2015-109384 filed on May 29, 2015, the contents of which are incorporated herein by reference.

BACKGROUND

Technical Field

The present invention relates to a heat spreading module suitable for dissipating heat of an electronic element which is a heat-generating body in a portable information terminal such as a smartphone or a tablet personal computer or an electronic device.

Description of the Related Art

In a portable information terminal or an electronic device, the amount of heat generation is increasing with increase in the amount of information processing, and need for suppressing rise in the temperature of an electronic element such as CPU is increasing in order to prevent malfunction due to heat, reduction in an information processing speed, or the like. Furthermore, in the portable electronic device, thickness reduction, weight reduction, and miniaturization are required in order to achieve satisfactory portability.

Conventionally, a portable terminal device formed so as to alleviate a heat spot due to heat generated by an integrated circuit has been described in Japanese Unexamined Patent Application, First Publication No. 2014-22798 A.

In a device described in Japanese Unexamined Patent Application, First Publication No. 2014-22798 A, an integrated circuit is disposed at an upper position of a casing, a battery is disposed at a lower position of the casing, and a graphite sheet attached to a back surface of a display panel is disposed so as to be able to transfer heat to the integrated circuit and the battery. Heat of the integrated circuit is diffused into the battery by the graphite sheet, and a heat spot is thereby alleviated.

In the structure described in Japanese Unexamined Patent Application, First Publication No. 2014-22798 A, a graphite sheet is laminated and disposed on a substrate provided with an integrated circuit or a battery, and therefore the graphite sheet is preferably thin for making a portable terminal device thinner or smaller. However, even though the graphite sheet has a high thermal conductivity, the amount of thermal conduction is reduced by reduction in thickness of the graphite sheet. Therefore, a heat dissipation function is deteriorated and the temperature of a heat spot is raised with reduction in thickness of the graphite sheet. Heat transfer (dissipation) by the graphite sheet occurs uniformly in the directions with a portion in contact with an integrated circuit as the center. That is, in the structure, the amount of heat transfer or a path for heat transfer cannot be selected. Therefore, even when there is a portion effective for cooling an integrated circuit such as a portion having a low temperature and a large heat capacity, for example, heat transfer to the portion cannot be promoted. That is, there is much room for improvement.

SUMMARY

The present invention has been made in view of the circumstances described above, and provides a heat spreading module capable of promoting heat dissipation by positively transferring heat, which is transferred to a heating portion, to a heat radiation portion and capable of being thinner.

A first aspect of the present invention provides a heat spreading module having a heating portion, to which heat is transferred from an outside, disposed in a portion of a thin plate-shaped main body and dissipating the heat transferred to the heating portion from the heating portion into another portion in the main body. The heat spreading module is formed in the main body such that a plurality of hollow paths passes though the heating portion, and the hollow paths communicate with each other in the heating portion. A working fluid which evaporates by heating and condenses by heat radiation is enclosed in the hollow paths. A wick which generates a capillary force by permeation of the working fluid in a liquid phase is disposed in each of the hollow paths such that a vapor flow path in which vapor of the working fluid flows is formed in each of the hollow paths. A part of each wick is positioned at the heating portion. The vapor flow paths formed in the hollow paths communicate with each other in the heating portion.

In a second aspect of the present invention according to the heat spreading module of the first aspect described above, the main body may include an upper plate, a lower plate disposed facing the upper plate, and a middle plate sandwiched between the upper plate and the lower plate, in which a portion corresponding to the hollow path is a penetrating portion.

In a third aspect of the present invention according to the heat spreading module of the second aspect described above, at least the upper plate and the lower plate among the upper plate, the lower plate, and the middle plate in the heat spreading module of the second aspect may be formed of a clad material obtained by laminating copper plates on a front surface and a back surface of a stainless steel plate or an aluminum plate.

In a fourth aspect of the present invention according to the heat spreading module of any one of the first aspect to the third aspect described above, the wick may include two thin wire bundles disposed in a longitudinal direction of each of the hollow paths and a porous body disposed between the thin wire bundles, and the thickness of the porous body may be smaller than the height of each of the thin wire bundles and the porous body may be recessed with respect to each of the thin wire bundles.

According to the aspects of the present invention described above, heat transferred to a heating portion is dissipated over an entire main body by thermal conduction of the main body, and a working fluid evaporates in each hollow path. The vapor flows in the hollow path toward a portion having a low pressure due to a low temperature, and is thereby transported by the working fluid in a longitudinal direction of the hollow path and is dissipated. The transportation of heat by the working fluid is transportation as latent heat of the working fluid, and a larger amount of heat is transported than in thermal conduction of the main body. Therefore, the present invention has excellent heat dissipation performance. In addition, the transportation amount of heat or the dissipation amount thereof in a portion in which the hollow path is formed is larger than that in a portion in which the hollow path is not formed. Therefore, by disposing the hollow path in a portion having a large amount of heat radiation, a large heat capacity for cooling, or the like, it is possible to increase the amount of heat transfer from the heating portion and to further improve heat dissipation performance or heat radiation performance.

According to the aspects of the present invention described above, the hollow paths communicate with each other in the heating portion, and a part of each wick is disposed in the heating portion. Therefore, in each hollow path, the whole working fluid in a liquid phase flows back to the heating portion. Therefore, the total amount of the working fluid evaporates and condenses without waste to transport heat. When heat is not easily transported in any one of the plurality of hollow paths, a working fluid in the hollow path flows into another hollow path to be used for heat transportation. Also in this point, the working fluid transports heat without waste. As a result, by communication of the hollow paths with each other in the heating portion and disposition of a part of each wick in the heating portion, heat dissipation performance can be improved more than ever.

DETAILED DESCRIPTION OF THE PREFERRED EMBODIMENTS

Figure 1:
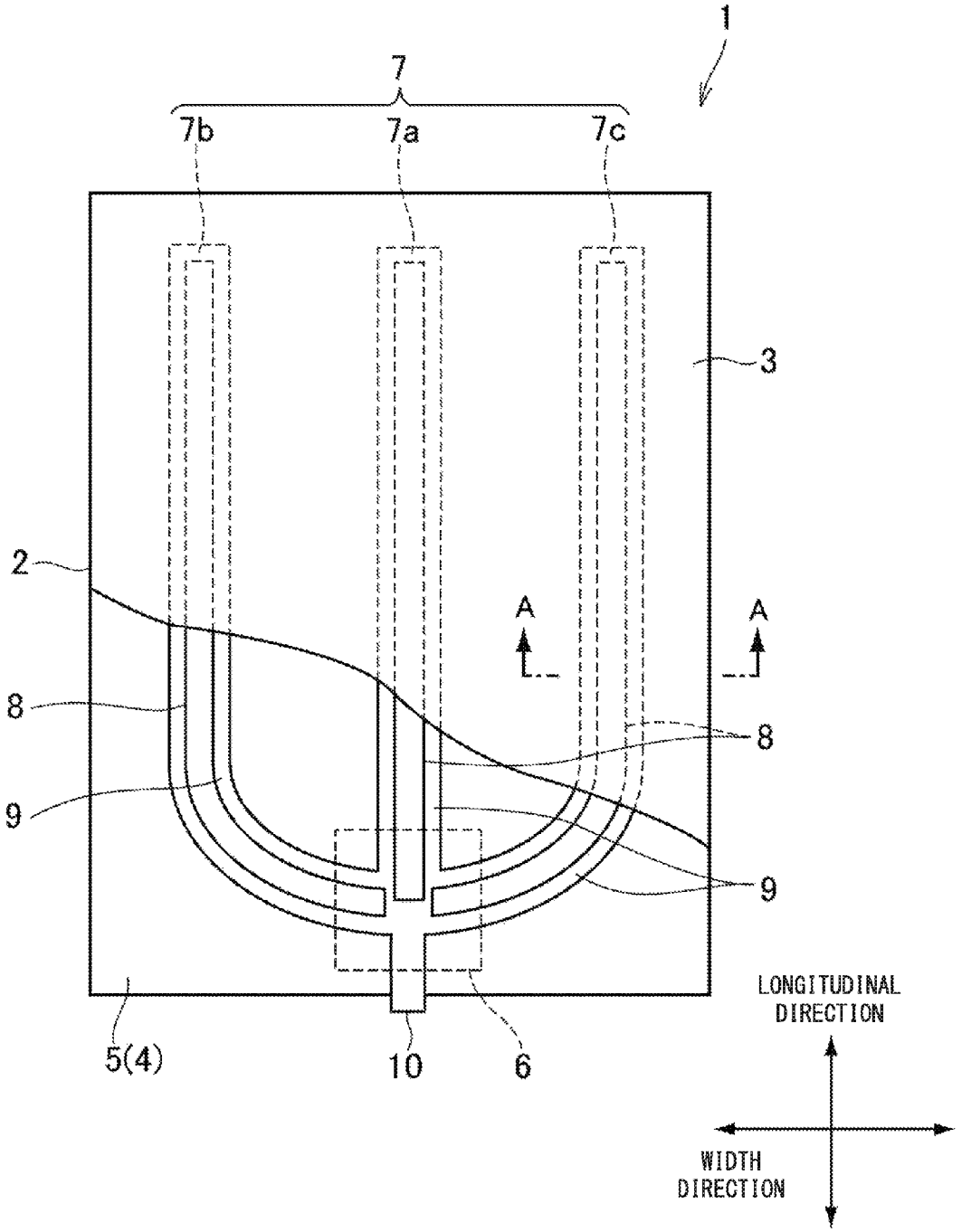
FIG. 1 is a plan view illustrating an upper plate after a part thereof has been removed, showing an embodiment of the present invention.
Figure 2:
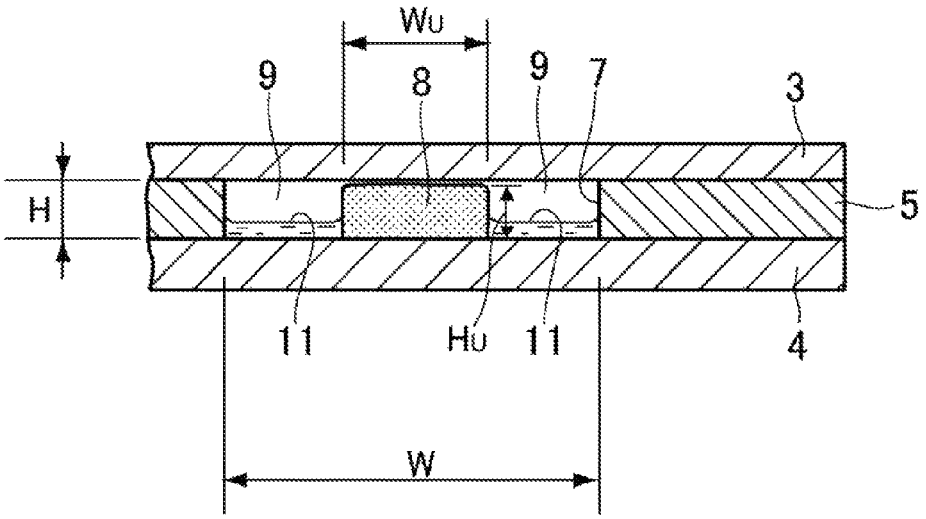
FIG. 2 is a cross sectional view cut along line A-A in FIG. 1.

FIG. 1 is a plan view exemplifying a heat dissipation plate (heat spreading module) 1 according to an embodiment of the present invention. FIG. 2 is a cross sectional view cut along line A-A in FIG. 1. The heat dissipation plate 1 includes a main body 2 formed into a thin rectangular plate shape. The main body 2 includes an upper plate 3, a lower plate 4, and a middle plate 5 each of which is a metal plate. Among these plates 3, 4, and 5, at least the upper plate 3 and the lower plate 4 are formed of a clad material integrated by laminating a stainless steel plate, an aluminum plate, or an aluminum alloy plate and copper plates disposed on a front surface and a back surface thereof. The middle plate 5 is preferably formed of a copper plate. The upper plate 3 and the middle plate 5 are bonded to each other and the middle plate 5 and the lower plate 4 are bonded to each other in an airtight state by an appropriate method. A preferable example of the bonding method is dissipation bonding using silver. Here, the following are examples of the thicknesses of these plates 3, 4, and 5. The thickness of each of the upper plate 3 and the lower plate 4 is approximately 0.09 mm. The thickness of the middle plate 5 is approximately 0.2 mm. Therefore, the thickness of the main body 2 is approximately 0.38 mm. The following is an example of the size of the main body 2. The width is approximately 70 mm, and the length is approximately 110 mm.

The heat dissipation plate 1 dissipates heat transferred to a part thereof. In the heat dissipation plate 1, one end (lower side in FIG. 1) in a longitudinal direction of the main body 2, positioned in the center in a width direction thereof, is a heating portion 6 to which heat is transferred from an outside. The heating portion 6 is an area with which a heat-generating body such as a calculation element (not illustrated) is bought into contact so as to be able to transfer heat, and is illustrated by a broken line in FIG. 1.

A thin belt-shaped penetrating portion 7 is formed in the middle plate 5. The penetrating portion 7 is formed in order to form a hollow path in the main body 2 by sandwiching the middle plate 5 between the upper plate 3 and the lower plate 4. In an example illustrated in FIG. 1, three penetrating portions 7 communicating with each other in the heating portion 6 are formed. The penetrating portion 7 will be described as a hollow path 7 hereinafter. The hollow path 7 is formed by sandwiching the middle plate 5 having a penetrating portion formed between the upper plate 3 and the lower plate 4. Therefore, the upper plate 3 or the lower plate 4 does not need to be subjected to processing such as grooving. Therefore, a surface of the upper plate 3 or the lower plate 4 can be kept flat.

In the present invention, the hollow path 7 may be formed into an appropriate shape as necessary. The shape of the hollow path 7 in the example illustrated in FIG. 1 will be described. In the example illustrated in FIG. 1, three hollow paths 7 are disposed, and a hollow path 7*a* in the center is linearly extended from the heating portion 6 in a longitudinal direction of the main body 2. Each of the hollow paths 7*b* and 7*c* on the left and the right is bent to the left or the right of the main body from the heating portion 6 and is extended, and then is linearly extended in the longitudinal direction of the main body 2 to be parallel to the hollow path 7*a* in the center with a predetermined gap therebetween. Therefore, the hollow paths 7*a*, 7*b*, and 7*c* communicate with each other in the heating portion 6. The width W of the hollow path 7 is approximately 10 mm, for example. The height (depth) H thereof is approximately 0.2 mm, the same as the thickness of the middle plate 5.

A wick 8 is disposed in each of the hollow paths 7*a*, 7*b*, and 7*c* over the approximately full length thereof. The wick 8 generates a capillary force by permeation of a working fluid in a liquid phase described below. The wick 8 is formed into an appropriate shape having a cross section of a rectangular shape, an elliptical shape, a semielliptical shape, or the like with a porous sintered body, a mesh material, an ultrathin wire bundle, or the like. The width WU thereof is set to be smaller than the width W of the hollow path 7. The width WU is approximately ⅓ of the width W of the hollow path 7, for example. By disposition of the wick 8 in the hollow path 7, a space is generated in the hollow path 7 along the wick 8 and the space is a vapor flow path 9. As illustrated in FIG. 2, when the wick 8 is disposed in the center of a width direction of the hollow path 7, the vapor flow paths 9 are formed on both sides with the wick 8 therebetween. In this case, by making the height HU of the wick 8 lower than the height H of the hollow path 7, the vapor flow paths 9 on both sides with the wick 8 therebetween may communicate with each other.

The hollow path 7 communicates with a nozzle 10. The nozzle 10 is formed in order to discharge the air from the hollow path 7 and to inject a working fluid 11 into the hollow path 7. For example, the nozzle 10 is formed by cutting a part of the middle plate 5 or by disposing a predetermined tube in the cut part. The working fluid 11 is enclosed in the hollow path 7 by this nozzle 10. The working fluid 11 may be selected appropriately considering the temperature at which the heat dissipation plate 1 is used. For example, water is used. The air may be discharged from the hollow path 7 and the working fluid 11 may be enclosed in the hollow path 7 by injecting the working fluid 11 in a regulated amount or more from the nozzle 10 into the hollow path 7, then heating the main body 2 and boiling the working fluid 1, expelling the air from the hollow path 7 with the vapor, and then closing (pinching off) the nozzle 10.

Next, a function of the heat dissipation plate 1 will be described. The heat dissipation plate 1 is used for an information device such as a portable terminal, and is disposed in a case together with a substrate, a battery, or the like. A heat-generating part mounted in a substrate, such as CPU, is bought into contact with the heating portion 6. Meanwhile, a portion opposite to the heating portion 6 in the longitudinal direction of the main body 2 is bought into contact with a member having a large heat capacity and radiating heat to an outside, such as a battery or a display panel, so as to be able to transfer heat. The working fluid 11 is heated by heat transferred to the heating portion 6 and evaporates. The vapor flows toward a portion having a low pressure due to a low temperature through the vapor flow path 9 formed in the hollow path 7. The vapor of the working fluid radiates heat in a portion having a low temperature and condenses. The working fluid 11 in a liquid phase generated thereby permeates the wick 8. In a portion of the wick 8 on a side of the heating portion 6, the working fluid 11 evaporates, the meniscus in a fine void is lowered, and a capillary force is generated. Therefore, the working fluid 11 in a liquid phase which has permeated the wick 8 flows back toward the heating portion 6 due to the capillary force.

The wick 8 includes a fine void such as a porous body, and therefore holds a working fluid in a liquid phase in the fine void. In the heat dissipation plate 1, the ends of all the wicks 8 are disposed in the heating portion 6. Therefore, a capillary force is applied to the working fluid 11 in a liquid phase permeating the wick 8, and the working fluid 11 flows back toward the heating portion 6. That is, the amount of the working fluid 11 left in a state in which the working fluid 11 permeating the wick 8 becomes zero or less. In the example illustrated in FIG. 1, heat is transported by the working fluid 11 in all the three hollow paths 7*a*, 7*b*, and 7*c*, and therefore the amount of heat transportation or the amount of dissipated heat becomes larger to suppress the rise in the temperature of the heating portion 6 effectively.

In addition, in the heat dissipation plate 1, all the hollow paths 7 or vapor flow paths 9 communicate with each other at the ends thereof on a side of the heating portion 6. Therefore, the working fluid 11 can flow into any one of the hollow paths 7*a*, 7*b*, and 7*c*. Therefore, when there is a difference in the amount of heat to be transported among the hollow paths 7*a*, 7*b*, and 7*c*, the working fluid 11 in a hollow path having a small amount of heat transfer flows into a hollow path having a large amount of heat transfer, and insufficiency of the working fluid 11 with respect to the amount of heat transfer (or heat load) can be avoided in advance. That is, dry-out does not occur in any one of the plurality of hollow paths 7, and heat is transported sufficiently in all the hollow paths 7*a*, 7*b*, and 7*c*. Also in this point, the amount of heat transportation or the amount of dissipated heat becomes larger to suppress the rise in the temperature of the heating portion 6 effectively. In this way, the heat dissipation plate 1 mainly transports heat with latent heat of the working fluid 11 and dissipates the heat. Therefore, even when the main body 2 is thinner, the amount of heat transported or dissipated is not particularly reduced. Therefore, the main body 2 or the heat dissipation plate 1 itself can be thinner.

A part of heat transferred to the heating portion 6 is dissipated over the entire main body 2 due to thermal conduction of the main body 2. As described above, the amount of heat transported by the working fluid 11 and dissipated is larger than the amount of dissipated heat due to such thermal conduction. Therefore, when there is a portion to receive a large amount of dissipated heat, a part of any hollow path 7 is disposed in the portion. In this way, the heating portion 6 is connected to the portion to receive a large amount of heat by any hollow path 7, and heat can be transported toward the portion intensively. As described above, according to the heat dissipation plate 1, a portion to transport a large amount of heat can be selected, and therefore a heat dissipation function or a cooling function of the heating portion 6 can be improved.

When heat is not transferred to (does not enter) the heating portion 6, the working fluid 11 condenses to become a liquid phase. Therefore, the inner pressure of the hollow path 7 becomes negative. However, in the heat dissipation plate 1, the upper plate 3 and the lower plate 4 included in the main body 2 are formed of a clad material obtained by disposing a stainless steel plate, an aluminum plate, or an aluminum alloy plate, and have a higher strength than a copper plate. Therefore, the upper plate 3 or the lower plate 4 is not recessed easily, and keeps a flat surface. Therefore, the flat surface of the heating portion 6 makes adhesion between the heating portion 6 and a heat-generating part such as CPU excellent to reduce heat resistance between the heat-generating part and the heating portion 6.

Figure 3:
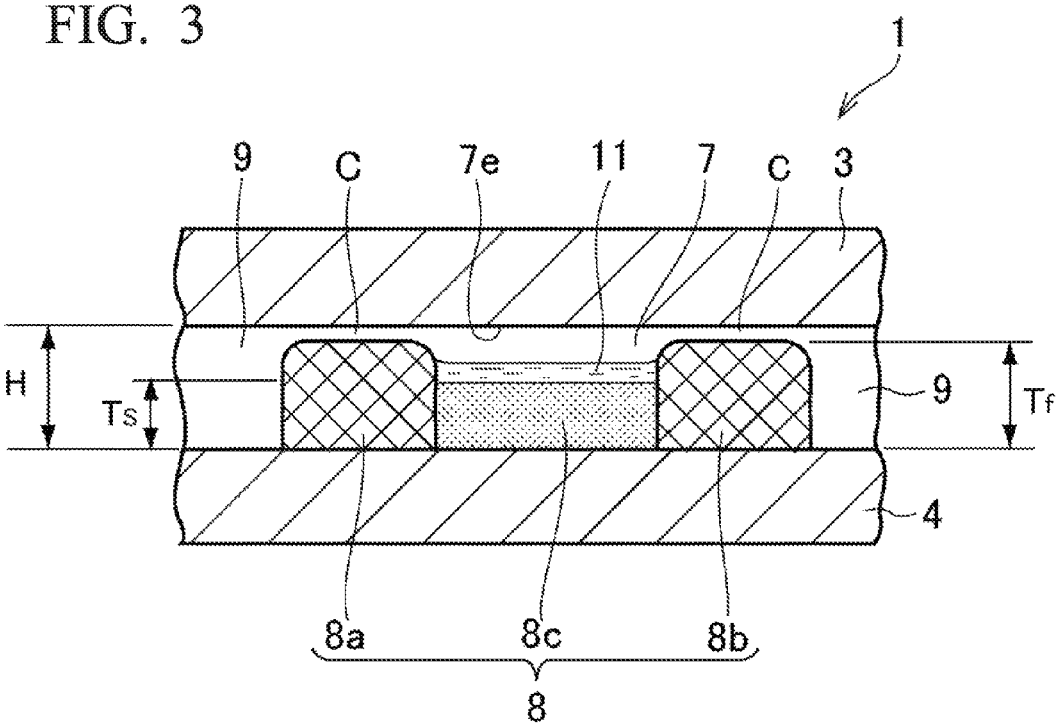
FIG. 3 is a cross sectional view illustrating another example of a wick.

Another structure of the wick 8 which can be employed in the present invention will be described. FIG. 3 is a cross sectional view of the wick 8 including thin wire bundles 8*a* and 8*b* and a porous body 8*c*. The thin wire bundles 8*a* and 8*b* are formed into slender shapes so as to be disposed in a longitudinal direction of the hollow path 7, are disposed on both sides with the porous body 8*c* therebetween, and the thin wire bundles 8*a* and 8*b* and the porous body 8*c* are integrated to form the wick 8. The thickness Ts of the porous body 8*c* is smaller than the thickness Tf of each of the thin wire bundles 8*a* and 8*b*. Therefore, the portion of the porous body 8*c* is recessed. The thickness Tf of each of the thin wire bundles 8*a* and 8*b* is lower than the height H of the hollow path 7, and a small gap C is formed between each of the thin wire bundles 8*a* and 8*b* and an upper surface 7*e* of the hollow path 7 in FIG. 3. The thin wire bundles 8*a* and 8*b* are formed of an ultrathin wire such as a carbon fiber or a copper fiber. The porous body 8*c* is formed by sintering metal powder such as copper powder so as to have a porous structure.

In the wick 8 having a structure illustrated in FIG. 3, the size of a void formed in each of the thin wire bundles 8*a* and 8*b* is larger than the size of a void formed in the porous body 8*c*, and there is a recessed space between the thin wire bundles 8*a* and 8*b*. The gap C is formed between each of the thin wire bundles 8*a* and 8*b* and the upper surface 7*e* of the hollow path 7. Therefore, the vapor flow paths 9 on both sides with the wick 8 therebetween communicate with each other through the space between the thin wire bundles 8*a* and 8*b* and the gap C. Therefore, vapor of the working fluid 11 is not enclosed in a specific vapor flow path 9, and the working fluid 11I can be supplied to the entire hollow path 7 to transport heat. The portion of the porous body 8*c* is recessed, and therefore, the working fluid 11 in a liquid phase can be held in the recessed portion as a liquid film. Therefore, evaporation of the working fluid 1 can be promoted particularly in the heating portion 6.

Figure 4:
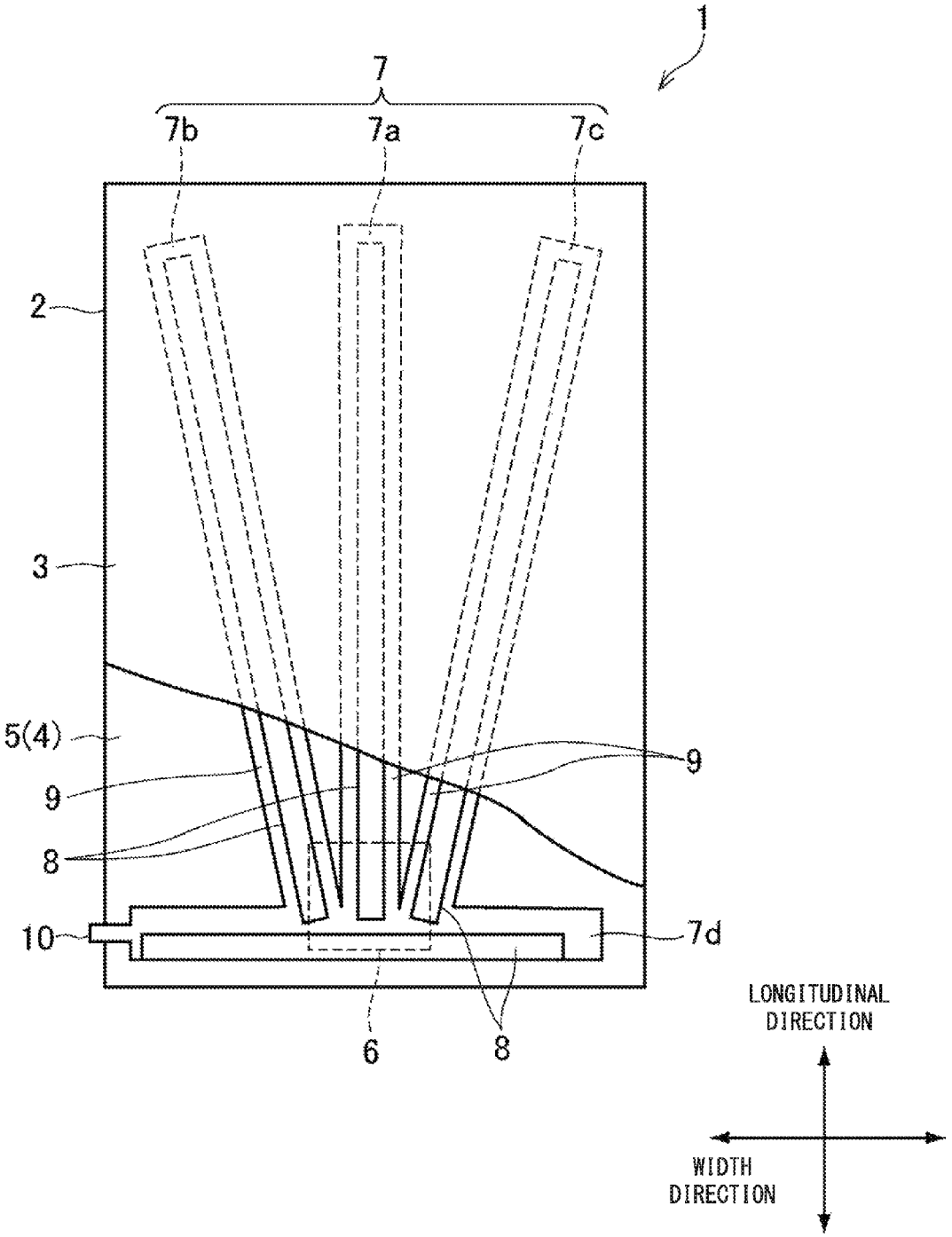
FIG. 4 is a plan view similar to FIG. 1 for describing another embodiment of the present invention.

In the heat dissipation plate 1 according to the present invention, the number or the shape of the hollow path 7 can be an appropriate number or shape as necessary. For example, FIG. 4 is a plan view indicating another embodiment of the present invention. In an example illustrated in FIG. 4, four linear hollow paths 7 are formed in the main body 2. The first to third three hollow paths 7*a*, 7*b*, and 7*c* are linearly extended from the heating portion 6 toward an end of the main body 2 opposite to the heating portion 6. Among the three hollow paths 7*a*, 7*b*, and 7*c*, the two hollow paths 7*b* and 7*c* on the left and the right are formed while being inclined with respect to the longitudinal direction of the main body 2 so as to be isolated from each other on the opposite side to the heating portion 6 in the main body 2. A fourth hollow path 7*d* which acts as a so-called header with respect to these hollow paths 7*a*, 7*b*, and 7*c* is disposed. These hollow paths 7*a* to 7*d* can be formed by forming a penetrating portion in the middle plate 5 as in the example illustrated in FIG. 1 and sandwiching the middle plate 5 between the upper plate 3 and the lower plate 4 to seal the penetrating portion.

The fourth hollow path 7*d* is formed in a width direction of the main body 2 so as to cross the heating portion 6. The wick 8 in the hollow path 7*d* is disposed at a position in contact with an inner wall surface, opposite to the portion in which the other hollow paths 7 communicate with each other. This disposition is made in order to prevent the vapor flow path 9 from being blocked by disposing one end in the heating portion 6 and making a space between a wick 8 disposed in the fourth hollow path 7*d* and a wick 8 disposed in another hollow path 7*a*, 7*b*, or 7*c*. The other structures in the example illustrated in FIG. 4 are similar to those described with reference to FIGS. 1 and 2. Therefore, description thereof will be omitted by imparting similar signs to the signs imparted in FIGS. 1 and 2 in FIG. 4.

According to the heat dissipation plate 1 illustrated in FIG. 4, by transfer of heat to the heating portion 6, the working fluid 11 evaporates in each of the hollow paths 7*a* to 7*d*, the vapor flows toward an end apart from the heating portion 6 in each of the hollow paths 7*a* to 7*d*, and then radiates heat and condenses. That is, heat is diffused into a portion apart from the heating portion 6 by the working fluid 11. In this case, the hollow paths 7*b* and 7*c* inclined with respect to the longitudinal direction of the main body 2 are formed linearly. Therefore, the amount of dissipated heat (or dissipation distance) in the width direction of the main body 2 by the hollow paths 7*b* and 7*c* is small in a portion close to the heating portion 6 in the main body 2. Meanwhile, heat is dissipated from the heating portion 6 toward both sides in the width direction of the main body 2 by the fourth hollow path 7*d*. Therefore, heat dissipation in the width direction of the main body 2 due to the linear hollow paths 7*b* and 7*c* is supplemented with the fourth hollow path 7*d*. Heat dissipation performance comparing favorably with the heat dissipation plate 1 illustrated in FIG. 1 is exhibited.

The present invention is not limited to the above specific examples. A communication path communicating the hollow paths 7 in a portion apart from the heating portion 6 may be disposed additionally. The shape of each of the hollow paths 7 may be an appropriate shape such as a meandering shape or a shape bent in zigzag in addition to a linear shape or a partially-curved shape.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A heat spreading module comprising a heating portion, to which heat is transferred from an outside, disposed in a portion of a thin plate-shaped main body and dissipating the heat transferred to the heating portion from the heating portion into another portion in the main body, wherein:

a plurality of hollow paths is formed in the main body so as to pass though the heating portion, and the hollow paths communicate with each other in the heating portion;

a working fluid which evaporates by heating and condenses by heat dissipation is enclosed in the hollow paths;

a wick which generates a capillary force by permeation of the working fluid in a liquid phase is disposed in each of the hollow paths such that a vapor flow path in which vapor of the working fluid flows is formed in each of the hollow paths;

a part of each wick is positioned at the heating portion, and the vapor flow paths formed in the hollow paths communicate with each other in the heating portion; and the wick comprises two thin wire bundles disposed along a longitudinal direction of each of the hollow paths and a porous body disposed between the thin wire bundles, and a thickness of the porous body is smaller than a height of each of the thin wire bundles and the porous body is recessed with respect to each of the thin wire bundles.

2. The heat spreading module according to claim 1, wherein the main body comprises an upper plate, a lower plate disposed facing the upper plate, and a middle plate sandwiched between the upper plate and the lower plate, in which a portion corresponding to at least one of the hollow paths is a penetrating portion.

3. The heat spreading module according to claim 2, wherein at least the upper plate and the lower plate among the upper plate, the lower plate, and the middle plate are formed of a clad material obtained by laminating copper plates on a front surface and a back surface of a stainless steel plate or an aluminum plate.

4. The heat spreading module according to claim 2, wherein the height of each of the thin wire bundles and the thickness of the porous body are each thicknesses in a direction from the lower plate to the upper plate, and the height of the thin wire bundles and a thickness of the porous body are each less than a shortest distance from the lower plate to the upper plate.

5. The heat spreading module according to claim 1, wherein each hollow path extends in an alternate direction from the heating portion and is in communication with each other of the hollow paths at the heating portion, each hollow path comprises at least one of the vapor flow paths which extend over the two thin wire bundles and the porous body in a direction of the main body in which the thickness of the porous body and the height of each of the thin wire bundles are arranged, and each of the vapor flow paths is open to each other of the vapor flow paths at the heating portion.

6. The heat spreading module according to claim 1, wherein the thin wire bundles and the porous body are in direct contact along a length of at least one of the plurality of hollow paths.

* * * * *